US011396769B2

(12) United States Patent
Kalb et al.

(10) Patent No.: US 11,396,769 B2
(45) Date of Patent: Jul. 26, 2022

(54) DRIVE ASSEMBLY FOR A WINDOW LIFTER HAVING A STOP RING FOR A CABLE DRUM

(71) Applicant: BROSE FAHRZEUGTEILE GMBH & CO. KOMMANDITGESELLSCHAFT, BAMBERG, Bamberg (DE)

(72) Inventors: Roland Kalb, Rossach (DE); Gabriele Lange, Marktrodach (DE)

(73) Assignee: BROSE FAHRZEUGTEILE GMBH & CO. KOMMANDITGESELLSCHAFT, BAMBERG, Bamberg (DE)

( * ) Notice: Subject to any disclaimer, the term of this patent is extended or adjusted under 35 U.S.C. 154(b) by 410 days.

(21) Appl. No.: 16/331,044

(22) PCT Filed: Sep. 5, 2017

(86) PCT No.: PCT/EP2017/072273

§ 371 (c)(1),
(2) Date: Mar. 6, 2019

(87) PCT Pub. No.: WO2018/046505

PCT Pub. Date: Mar. 15, 2018

(65) Prior Publication Data

US 2019/0218846 A1 Jul. 18, 2019

(30) Foreign Application Priority Data

Sep. 6, 2016 (DE) ..... 102016216877.0

(51) Int. Cl.
*E05F 15/697* (2015.01)
*E05F 15/689* (2015.01)
(Continued)

(52) U.S. Cl.
CPC ..... *E05F 15/697* (2015.01); *E05F 11/483* (2013.01); *E05F 15/689* (2015.01);
(Continued)

(58) Field of Classification Search
CPC ..... E05F 15/697; E05F 15/689; E05F 11/48; E05F 11/03; E05F 11/483
See application file for complete search history.

(56) References Cited

U.S. PATENT DOCUMENTS 5,367,827 A * 11/1994 Tajima ..... E05F 11/486 242/364
6,634,142 B2 * 10/2003 Dobson ..... B60J 5/0416 49/352
(Continued)

FOREIGN PATENT DOCUMENTS

DE 102004044863 A1 3/2006
DE 102007046885 A1 3/2009
(Continued)

*Primary Examiner* — Gregory J Strimbu
(74) *Attorney, Agent, or Firm* — Brooks Kushman P.C.

(57) ABSTRACT

A power window actuator includes a carrier element having an opening, a cable drum includes a portion is inserted into the opening of the carrier element in such a manner that the portion at least partially extends through the opening, and a cable exit housing disposed on a first side of the carrier element includes a bearing element supporting the cable drum on the first side of the carrier element so as to be rotatable about a rotation axis. At least one bearing element projects radially with respect to the rotation axis from the portion, the bearing element engaging a counter bearing on a periphery of the carrier element surrounding the opening of the carrier element.

10 Claims, 7 Drawing Sheets

(51) Int. Cl.
*E05F 11/48* (2006.01)
*E05F 11/38* (2006.01)

(52) U.S. Cl.
CPC ..... *E05F 11/382* (2013.01); *E05Y 2201/664* (2013.01); *E05Y 2201/668* (2013.01); *E05Y 2600/53* (2013.01)

(56) References Cited

U.S. PATENT DOCUMENTS

| | | | | |
|---|---|---|---|---|
| 7,051,479 | B2 * | 5/2006 | Chonavel | B60J 5/0406 49/352 |
| 7,059,085 | B1 | 6/2006 | Chu | |
| 8,627,745 | B2 * | 1/2014 | Uchimura | E05F 15/697 74/606 R |
| 2002/0007596 | A1 * | 1/2002 | Cabanne | E05F 15/697 49/352 |
| 2003/0160124 | A1 | 8/2003 | Hemond et al. | |
| 2005/0016071 | A1 * | 1/2005 | Takeda | B60J 5/0416 49/352 |
| 2010/0043294 | A1 | 2/2010 | Klippert et al. | |
| 2019/0203518 | A1 * | 7/2019 | Kalb | E05F 15/697 |
| 2019/0203519 | A1 * | 7/2019 | Kalb | E05F 11/483 |
| 2019/0234130 | A1 * | 8/2019 | Kalb | E05F 15/697 |
| 2019/0277079 | A1 * | 9/2019 | Lange | E05F 15/697 |
| 2019/0284863 | A1 * | 9/2019 | Kalb | H02K 21/22 |
| 2020/0056416 | A1 * | 2/2020 | Kalb | E05F 15/697 |
| 2021/0003156 | A1 * | 1/2021 | Arimoto | E05F 15/643 |

FOREIGN PATENT DOCUMENTS

| | | | |
|---|---|---|---|
| EP | 1347139 | A1 | 9/2003 |
| JP | 2001132319 | A | 5/2001 |
| KR | 20130073580 | A | 7/2013 |

* cited by examiner

DRIVE ASSEMBLY FOR A WINDOW LIFTER HAVING A STOP RING FOR A CABLE DRUM

CROSS-REFERENCE TO RELATED APPLICATIONS

This application is the U.S. National Phase of PCT Application No. PCT/EP2017/072273, filed on Sep. 5, 2017, which claims priority to German Patent Application No. 10 2016 216 877.0, filed on Sep. 6, 2016, the disclosures of which are incorporated in their entirety by reference herein.

TECHNICAL FIELD

The disclosure relates to a drive device for an adjustment installation for adjusting a vehicle part, in particular a power window actuator.

BACKGROUND

Vehicles may include one or more drive devices to adjust a vehicle part. A drive device of this type may include a carrier element having an opening and a cable drum which by way of a portion is inserted into the opening of the carrier element in such a manner that the portion at least partially extends through the opening. A cable exit housing is disposed on a first side of the carrier element, said cable exit housing having a bearing element which on the first side of the carrier element mounts the cable drum so as to be rotatable about a rotation axis.

A drive device of this type can in particular be a component part of a power window installation and can thus serve for adjusting a window glass. However, such a drive device can also serve for adjusting another adjustment element, for example a sliding roof or the like, in a vehicle.

In the case of a power window actuator, one or a plurality of guide rails on which one entrainment element that is coupled to a window glass is in each case guided can be disposed on an apparatus carrier of a door module, for example. The entrainment element is coupled to the drive device by way of a flexurally limp traction cable which is conceived for transmitting (exclusively) tensile forces, wherein the traction cable is disposed on the cable drum in such a manner that the traction cable, in a rotating movement of the cable drum, by way of one end is wound onto the cable drum and by way of another end is unwound from the cable drum. A displacement of a cable loop formed by the traction cable thus takes place and correspondingly, a movement of the entrainment element along the respectively assigned guide rail. The window glass, driven by the drive device, can thus be adjusted so as to release or close a window opening on a door on the side of a vehicle, for example.

SUMMARY

It is an object underlying the proposed solution to make available a drive device which is particularly simple to assemble and when in operation can have a favorable operational behavior.

This object is achieved by a subject matter having features as described herein.

Accordingly, at least one bearing element which projects radially to the rotation axis from the portion is disposed on the portion of the cable drum, said bearing element engaging radially across a counter bearing on a periphery of the carrier element surrounding the opening of the carrier element in such a manner that the counter bearing blocks a movement of the cable drum through the opening of the carrier element.

The cable drum by way of a portion engages through the opening of the carrier element and by way of the portion at least partially protrudes through the opening of the carrier element. The cable drum by way of a body carrying a cable channel, herein comes to lie on the first side of the carrier element and is encompassed by the cable exit housing such that the cable drum is held on the carrier element by way of the cable exit housing.

In order for the cable drum to be assembled on the carrier element the cable drum, conjointly with the cable exit housing, is attached to the carrier element. A pre-assembled unit which can then be completed by attaching a drive housing from the other side of the carrier element can thus be achieved by connecting the cable exit housing to the carrier element, without particular precautions having to be taken for the cable drum to be held in position on the first side of the carrier element. In particular, the cable drum after being attached to the carrier element cannot slip through the opening in the carrier element, such that the assembly of the cable drum on the carrier element is simple, and the completion by way of a drive housing can also be performed in a simple manner from the other side.

The counter bearing on the carrier element may be formed by a bearing ring that surrounds the opening of the carrier element. The bearing ring herein can project in a radially inward manner from a circumferential periphery, for example in the form of a bead circumferentially surrounding the opening, and thus achieve a bearing for the at least one bearing element on the portion of the cable drum. The diameter of the bearing ring is smaller than the diameter of a circle enveloping the bearing elements such that the bearing elements prevent the cable drum from slipping through the opening of the carrier element.

The cable drum may have a plurality of bearing elements that are mutually spaced apart circumferentially on the portion. The bearing elements herein can be disposed so as to be mutually distributed in a uniform manner on the portion.

In one advantageous design embodiment the cable exit housing is connected in a positive-locking manner to the carrier element by way of latch-fit connection, and in this way, at least in a pre-assembly position after attaching the cable exit housing to the carrier element but before completing the drive device by way of a drive housing for receiving a motor unit, is held on the carrier element. The cable exit housing is thus already secured on the carrier element in the pre-assembly position and cannot fall off the carrier element after being attached to the carrier element. The cable drum is also held on the carrier element by way of the cable exit housing such that a pre-assembled unit for the further assembly is achieved.

In the operation of the drive device, torques can act on the cable exit housing by way of the cable drum that is mounted on the bearing element of the cable exit housing. It is thus to be guaranteed that the cable exit housing in the operation of the drive device cannot rotatingly move in relation to the carrier element. An anti-rotation safeguard is thus to be provided between the cable exit housing and the carrier element.

To this end, the at least one housing portion by way of which the base of the cable exit housing is connected to the carrier element can be established in a rotationally fixed manner on the carrier element, for example. A positive-lock element which in the case of an assembled cable exit housing engages with a positive-lock opening on the respective other component (thus the carrier element or the base portion of the at least one housing portion) can thus be provided on a base portion of the at least one housing portion or the carrier element. An anti-rotation safeguard between the cable exit housing and the carrier element is thus provided by way of the engagement of the positive-lock element in the positive-lock opening. Torques can be absorbed in a favorable manner on account of the at least one housing portion being radially spaced apart from the rotation axis and thus acting radially outside the rotation axis, around which the cable drum is rotatable.

The cable exit housing by way of the at least one housing portion herein is axially supported on the carrier element and, by axially bracing the cable exit housing in relation to the drive housing, is also braced in relation to the carrier element. The tension force of the fastening element is supported on the carrier element by way of the at least one housing portion.

The latch-fit connection in the pre-assembly position can herein also be produced by way of the base portion on the at least one housing portion of the cable exit housing. It can thus be provided that each positive-lock element in the pre-assembly position is held so as to latch in the assigned positive-lock opening, for example by providing a latching cam on the positive-lock element or the positive-lock opening, and an assigned latching clearance on the respective other component. A latching, positive-lock connection which holds the cable exit housing on the carrier element already in the pre-assembled position is thus produced by attaching the cable exit housing by way of the base portions thereof on the carrier element, and by engaging the positive-lock elements in the positive-lock openings.

The drive device may include a drive wheel that is drivable by a motor unit, and a drive housing which is disposed on a second side, facing away from the first side, of the carrier element and which has a further, second bearing element for mounting the drive wheel so as to be rotatable about the rotation axis. The cable exit housing is thus attached to the first side of the carrier element and there mounts the cable drum. The drive housing is attached to the second, facing away, side of the carrier element and there mounts the drive wheel.

In operation, the drive wheel and the cable drum are connected to one another in a rotationally fixed manner and are conjointly rotated so as to transmit torques from the motor unit toward the cable drum and, on account thereof, to move an adjustment element. The rotationally fixed connection between the cable drum and the drive wheel herein can be produced, for example, by way of a mutual engagement, for example meshing, of positive-lock elements, to which end a toothing of the cable drum meshes with an assigned toothing of the drive wheel and, on account thereof, produces a rotationally fixed connection. The cable drum can have a ring gear having an internal toothing, for example, said ring gear being placed onto a connecting wheel by an external toothing, for example, of the drive wheel. The ring gear herein can configure the portion which extends through the opening of the carrier element and on which the at least one bearing element is formed, such that the cable drum by way of the portion implementing the ring gear extends through the opening to the drive wheel and on the second side of the carrier element which is assigned to the drive housing is coupled to the drive wheel.

In one design embodiment the cable exit housing and the drive housing are fastened to one another by way of a fastening element that acts between the bearing element of the cable exit housing and the bearing element of the drive housing. A very simple assembly results on account of the cable exit housing on the first side of the carrier element, and the drive housing on the other, second side of the carrier element, being fastened to one another and therefore being established on the carrier element by way of a (single) fastening element which acts between bearing elements. For the assembly, the cable exit housing, on the one hand, and the drive housing, on the other hand, can in particular be attached to the carrier element so as to thereafter connect the cable exit housing and the drive housing to one another, and may mutually brace in an axial manner said cable exit housing and said drive housing, by way of the fastening element, for example a screw element, such that the carrier element is jammed between the cable exit housing and the drive housing.

The fastening element herein can engage from one of the bearing elements into the other of the bearing elements and, on account thereof, connect the bearing elements to one another. The cable exit housing, on the one hand, and the drive housing, on the other hand, are thus mutually established by way of the bearing elements.

For example, in the case of an arrangement according to the intended use on a vehicle, the cable drum is disposed on a door on the side of the vehicle, for example in a wet space, while the motor unit of the drive device lies in a dry space. The separation between the wet space and the dry space herein can be provided by the carrier element, for example an apparatus carrier, made of plastics, of a door module. Such a wet space/dry space separation can be maintained in a simple manner on account of the assembly of the cable exit housing on the one side of the carrier element and of the drive housing on the other side of the carrier element, and on account of the connection by way of a (single) central fastening element, without said wet space/dry space separation being compromised by fastening elements that engage from one side to the other.

The bearing element of the cable exit housing serves for mounting the cable drum and to this end can for example be configured as a cylindrical bearing dome which projects from a base of the cable exit housing. Moreover, the bearing element of the drive housing, which serves for mounting the drive wheel on the side of the carrier element that faces away from the cable drum, can be configured as a cylindrical bearing dome on the drive housing. The bearing domes are axially mutually braced by way of the fastening element, such that the cable exit housing, on the one hand, and the drive housing, on the other hand, are established on the carrier element by way of said bracing.

In one design embodiment the drive housing can have at least one fastening installation, for example a fastening bush having a positive-lock opening molded therein, which is radially spaced apart from the rotation axis. The drive housing by way of the fastening installation can also be established in a rotationally fixed manner on the carrier element, such that torques acting about the rotation axis can be absorbed and discharged and in particular cannot lead to the drive housing being rotated on the carrier element.

In order for the drive housing to be secured against rotation on the carrier element, a positive-lock element, which is disposed on the carrier element or the fastening installation of the drive housing, may engage in a positive-locking manner in a positive-lock opening which is formed on the respective other component (thus the fastening installation of the drive housing or the carrier element). Torques can be absorbed and discharged by way of the positive-lock engagement, such that the drive housing is established in a rotationally fixed manner on the carrier element.

A damping element which forms an elastic, damping intermediate layer between the positive-lock element and the wall of the positive-lock opening can be disposed herein on the positive-lock element. In this way, an acoustic decoupling between the drive housing and the carrier element can be achieved when in operation.

Both the cable exit housing as well as the drive housing can thus be secured in a positive-locking and rotationally fixed manner on the carrier element. This positive-lock fit is produced in a self-acting manner when the cable exit housing is attached to the first side of the carrier element and when the drive housing is attached to the second side of the carrier element, without special assembly steps being required to this end and further fastening elements, for example in the form of screw elements, having to be attached. The (axial) mutual establishment of the cable exit housing and the drive housing may be performed solely by way of the fastening element that acts centrally between the bearing elements of the cable exit housing and of the drive housing.

BRIEF DESCRIPTION OF THE DRAWINGS

The concept on which the solution is based is to be explained in more detail hereunder by means of the exemplary embodiments illustrated in the figures.

DETAILED DESCRIPTION

Such a drive device has generally to be designed so as to make available a torque of sufficient strength in order for the window glass to be adjusted. The drive device herein is to be able to have a small installation space, is to be easily assembled for example on an assigned carrier element, for example the apparatus carrier of a door module, and when in operation is to have a favorable operational behavior together with a low generation of noise, for example on a door module of a vehicle door.

In the case of a drive for an adjustment installation in a motor vehicle, known from DE 10 2004 044 863 A1, a cable drum is disposed on a bearing mandrel of a drive housing, wherein the drive housing by way of a fastening element in the form of a screw is connected to a carrier element in the form of an apparatus carrier.

FIGS. 1A, 1B to 9 show an exemplary embodiment of a drive device 1 which can be used, for example, as a drive in an adjustment installation for adjusting a window glass, for example of a side door of a vehicle.

Figure 10:
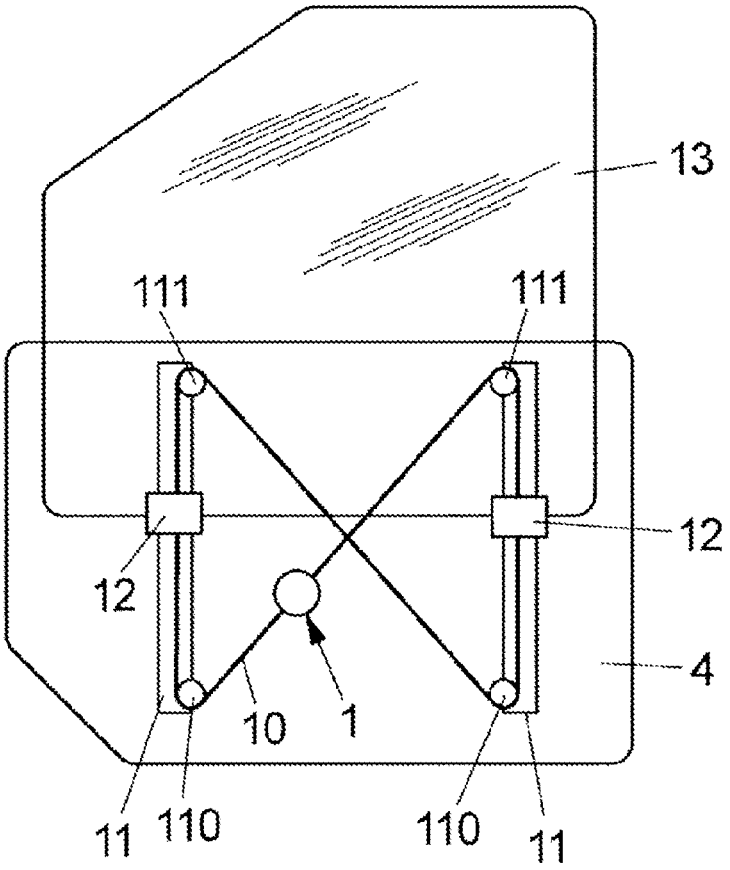
FIG. 10 shows a schematic view of an adjustment installation of a vehicle in the form of a power window actuator.

Such an adjustment installation in the form of a power window actuator, illustrated in an exemplary manner in FIG. 10, has a pair of guide rails 11, for example, on which one entrainment element 12 which is coupled to a window glass 13 is in each case adjustable. Each entrainment element 12 is coupled to a drive device 1 by way of a traction cable 10 which is configured for transmitting (exclusively) tensile forces, wherein the traction cable 10 configures a closed cable loop and to this end, by way of the ends of said traction cable 10, is connected to a cable drum 3 (cf. FIGS. 1A and 1B, for example) of the drive device 1. The traction cable 10 extends from the drive device 1 around deflection rollers 110 on the lower ends of the guide rails 11 to the entrainment elements 12, and from the entrainment elements 12 around deflection rollers 111 at the upper ends of the guide rails 11 back to the drive device 10.

When in operation, a motor unit of the drive device 1 drives the cable drum 3 in such a manner that the traction cable 10 by way of one end is wound onto the cable drum 3, and by way of the other end is unwound from the cable drum 3. On account thereof, the cable loop formed by the traction cable 10 is displaced without any change in the freely extended cable length, this leading to the entrainment elements 12 being moved in the same direction on the guide rails 11 and the window glass 13, on account thereof, being adjusted along the guide rails 11.

The power window actuator in the case of the exemplary embodiment according to FIG. 10 is disposed on an apparatus carrier 4 of a door module. The apparatus carrier 4 can, for example, be established on an internal door panel of a vehicle door and represents a pre-assembled unit which, in the pre-assembled state having the power window actuator disposed on the apparatus carrier 4, can be assembled on the vehicle door.

The drive device 1 of the exemplary embodiment according to FIGS. 1A, 1B to 9 is disposed on an area portion 40 of a carrier element 4 which is implemented, for example, by an apparatus carrier and has a cable exit housing 2 disposed on a first side of the carrier element 4, and a drive housing 7 disposed on a second side of the carrier element 4, said second side facing away from the first side. The cable exit housing 2 serves for mounting the cable drum 3 on the carrier element 4, while the drive housing 7 encloses inter alia a drive wheel 6 which can be driven by way of a motor unit 8 and is connected to the cable drum 3 such that the cable drum 3 can be driven by rotating the drive wheel 6.

The cable drum 3 on the first side of the carrier element 4, when disposed according to the intended use on a vehicle door of a vehicle, for example, is disposed in a wet space of the vehicle door. By contrast, the drive housing 7 is located in the dry space of the vehicle door. The separation between the wet space and the dry space is established by way of the carrier element 4, and the interface between the drive wheel 6 and the cable drum 3 is accordingly to be sealed in a moisture-proof manner such that no moisture make its way from the wet space to the dry space.

The cable exit housing 2 has a base 20, a cylindrical bearing element 22 in the form of a bearing dome that projects centrally from the base 20, and housing portions 21 in the form of housing webs which extend so as to be parallel to the cylindrical bearing element 22 and are radially spaced apart from the bearing element 22. The cable drum 3 is rotatably mounted on the bearing element 22 and herein is enclosed by the cable exit housing 2 in such a manner that the cable drum 3 is held on the carrier element 4.

The cable drum 3 has a body 30 and, on the circumferential shell face of the body 30, has a cable channel 300 for receiving the traction cable 10, said cable channel 300 being molded in the body 30. The cable drum 3 by way of a ring gear 31 is inserted in an opening 41 of the carrier element 4 and is connected in a rotationally fixed manner to the drive wheel 6 such that a rotating movement of the drive wheel 6 leads to a rotating movement of the cable drum 3.

The drive housing 7 by way of an interposed sealing element 5 is attached to the other, second side of the carrier element 4 and has a housing case 70 having a bearing element 72 in the form of a cylindrical bearing dome which is configured centrally in said housing case 70 and which engages through an opening 62 of the drive wheel 6 and which in this way rotatably mounts the drive wheel 6. A worm housing 74 adjoins the housing case 70, a drive worm 81 which is connected in a rotationally fixed manner to a drive shaft 800 of an electric motor 80 of the motor unit 8 lying in said worm housing 74 and by way of a worm toothing meshing with an external toothing 600 of a body 60 of the drive wheel 6. The drive shaft 800, at the end thereof that faces away from the electric motor 80, by way of a bearing 82 is mounted in the worm housing 74. The electric motor 80 herein lies in a motor case 73 of the drive housing 7, said motor case 73 by way of a housing cover 75 being closed in relation to the outside.

The drive housing 7 moreover has an electronics housing 76 in which a circuit board 760 having control electronics disposed thereon is enclosed. The electronics housing 76 is closed in relation to the outside by way of a housing plate 761 having a plug connector 762 for the electrical connection of the electronics of the circuit board 760 disposed on said housing plate 761.

The drive wheel 6, so as to project axially from the body 60, has a connecting wheel 61 having an external toothing 610 molded thereon, said connecting wheel 61 engaging with the ring gear 31 of the cable drum 3 in such a manner that an internal toothing 310 of the ring gear 31 (cf. FIG. 1B, for example) connects in a meshing manner with the external toothing 610 of the connecting wheel 61. The drive wheel 6 and the cable drum 3 are in this way connected in rotationally fixed manner to one another such that the cable drum 3 is rotatable on the carrier element 4 by driving the drive wheel 6.

In order for the drive device 1 to be assembled, the cable exit housing 2 is attached to the carrier element 4, on the one hand, and the drive housing 7 is attached to the carrier element 4, on the other hand. The fastening to the carrier element 4 is in this instance performed in that a fastening element 9 in the form of a screw element is inserted into an engagement opening 721 on the lower side of the drive housing 7 in such a manner that the fastening element 9 extends through an opening 720 in the bearing element 72 of the drive housing 7 (cf. FIG. 9) and engages centrally in an opening 221 within the bearing element 22 of the cable exit housing 2. The cable exit housing 2 and the drive housing 7 by way of the fastening element 9 are mutually axially braced on the bearing elements 22, 72 and are thereon established on the carrier element 4.

A thread for receiving the fastening element 9 can be molded within the opening 221 of the bearing element 22 of the cable exit housing 2. However, it is also conceivable and possible for the fastening element 9 to be screwed into the opening 221 in a self-tapping manner.

For assembly, the cable exit housing 2 is attached to the first side of the carrier element 4 such that the cable exit housing 2 encloses the cable drum 3 and holds the latter on the carrier element 4 as is illustrated in FIGS. 2A to 4A, 4B. The cable exit housing 2 herein, by way of the housing portions 21 thereof that are radially spaced apart from the bearing element 22, by way of base portions 210 comes to bear on a contact ring 45 which circumferentially surrounds an opening 41 in the carrier element 4. Axially projecting positive-lock elements 42 in the form of web-shaped pins are configured on the contact ring 45, said positive-lock elements 42, when attaching the cable exit housing 2 to the carrier element 4, engaging with positive-lock openings 212 (cf. FIG. 4B) on the base portions 210 of the housing portions 21, and in this way achieving an anti-rotation safeguard about the rotation axis D between the cable exit housing 2 and the carrier element 4, said rotation axis D being defined by the bearing element 22.

The web-shaped positive-lock elements 42, when viewed along the circumferential direction about the bearing element, on the lateral edges thereof can extend in an oblique manner (at a minor angle) such that the housing portions 21 when plug-fitting the base portions 210 onto the positive-lock elements 42 are established on the positive-lock elements 42 so as to be free of play along the circumferential direction.

Figure 6:
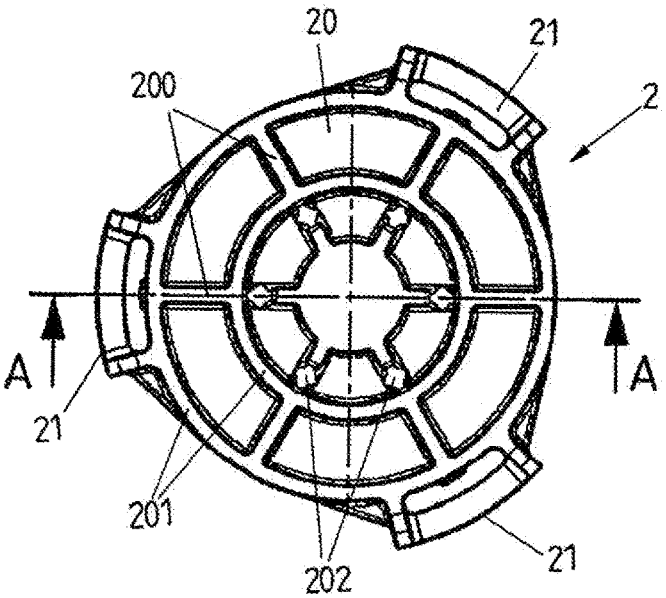
FIG. 6 shows a plan view of the cable exit housing.
Figure 7:
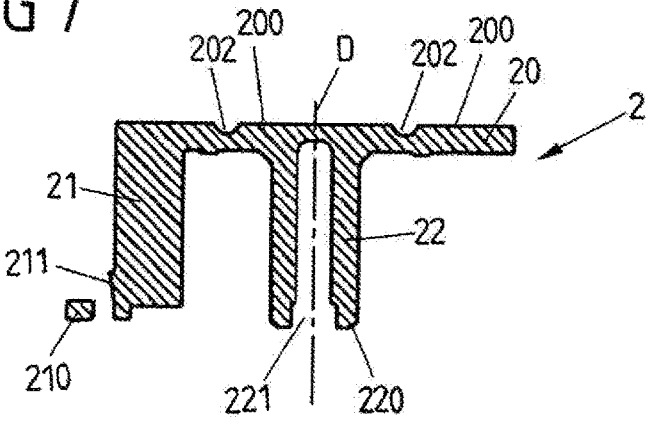
FIG. 7 shows a cross-sectional view along the line 7-7 according to FIG. 6.
Figure 8:
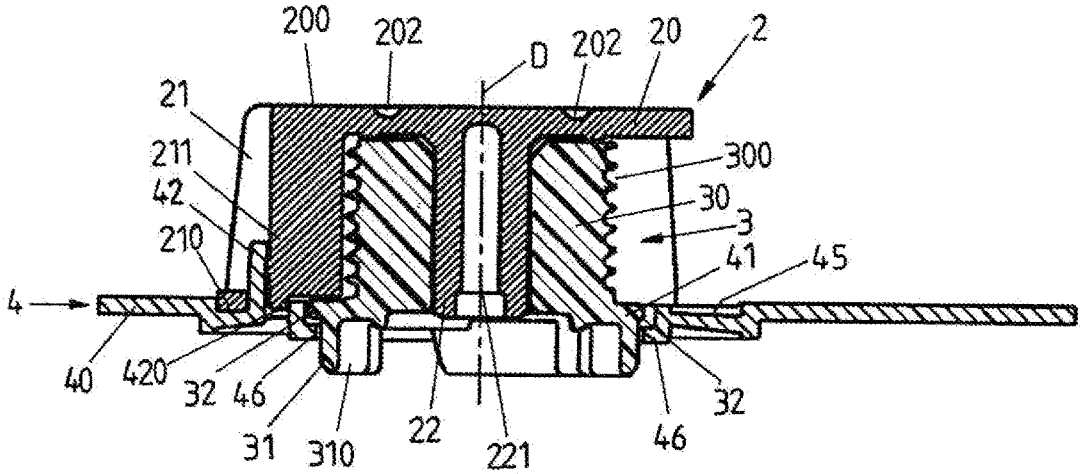
FIG. 8 shows the cross-sectional view according to FIG. 7, with the cable exit housing attached to the carrier element.

Latching clearances 420 (cf. FIG. 1A, for example) in which latching elements 211 in the form of outwardly projecting latching cams on the housing portions 21 engage in the case of an attached cable exit housing 2 are provided on the internal side of the positive-lock elements 42, as can be seen, for example, in FIG. 6 to FIG. 8. The cable exit housing 2, conjointly with the cable drum 3 enclosed therein, is held on the carrier element 4 in a pre-assembly position by way of said latching connection, even when the drive housing 7 is not yet braced in relation to the cable exit housing 2 by way of the fastening element 9. The latching connection thus simplifies the assembly and prevents the cable exit housing 2 from falling off in the case of an as yet unassembled drive housing 7.

The cable drum 3 in the pre-assembly position, by way of radially projecting bearing elements 32 on the upper periphery of the ring gear 31 (cf. FIG. 1A, for example) comes to bear on a bearing ring 46 within the opening 41 of the carrier element 4 (cf. FIG. 8, for example), such that the cable drum 3 in the pre-assembly position cannot slip through the opening 41 and is held on the carrier element 4 by way of the cable exit housing 2.

The bearing elements 32 serve in particular for securing the position of the cable drum 3 on the carrier element 4 in the pre-assembly position. Upon complete assembly of the drive device 1 the cable drum 3 is connected to the drive wheel 6 by way of the ring gear 31 and is axially established between the cable exit housing 2 and the drive housing 7.

Axially extending securing elements 23 that project in a radially inward manner are disposed on the internal sides of the housing portions 21, said securing elements 23 facing the cable channel 300 on the shell face of the body 30 and when in operation, sliding along said shell face. It is ensured by way of said securing elements 23 that the traction cable 10 received in the cable channel 300 cannot jump out of the cable channel 300.

Figure 1A:
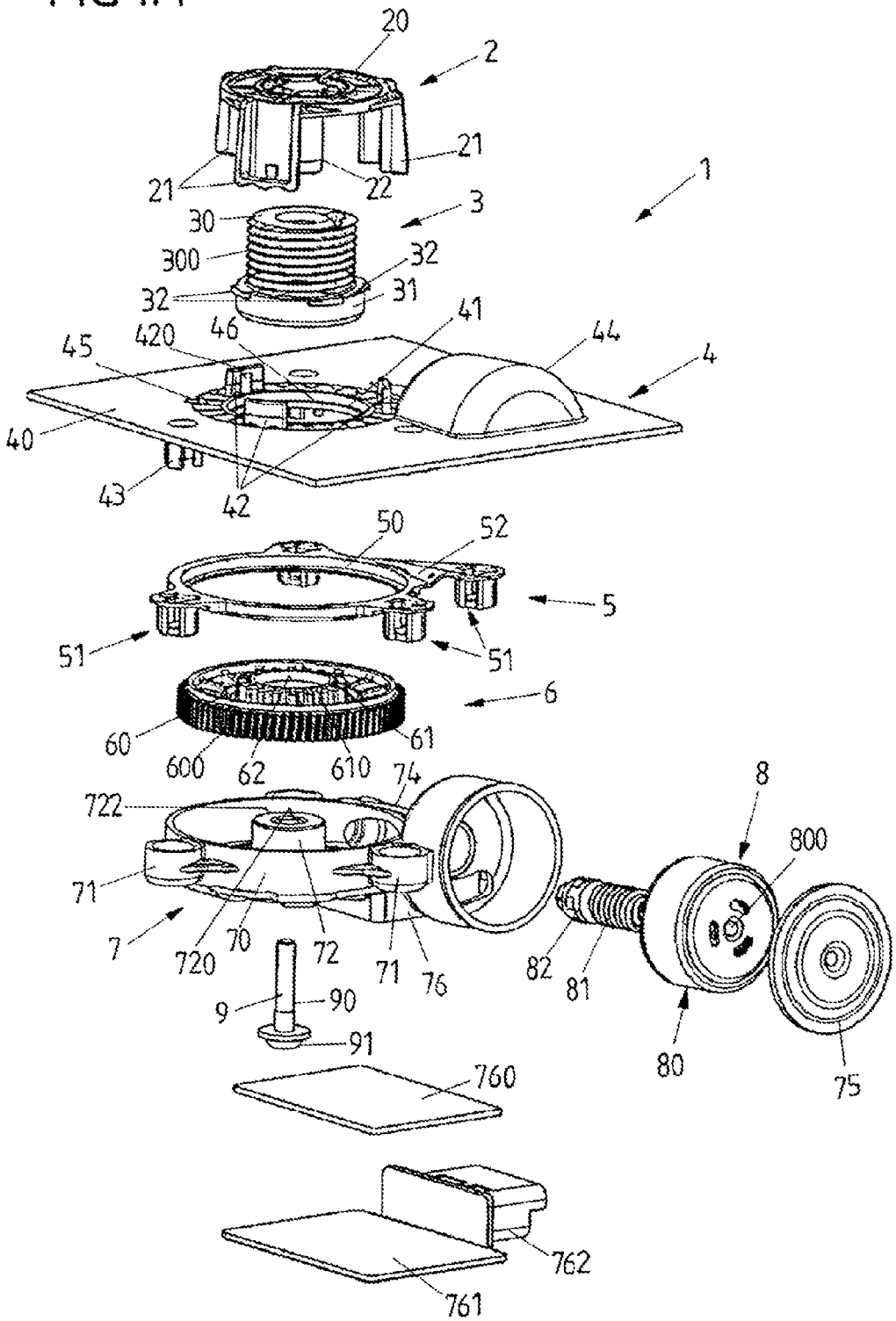
FIG. 1A shows an exploded view of an exemplary embodiment of a drive device.
Figure 1B:
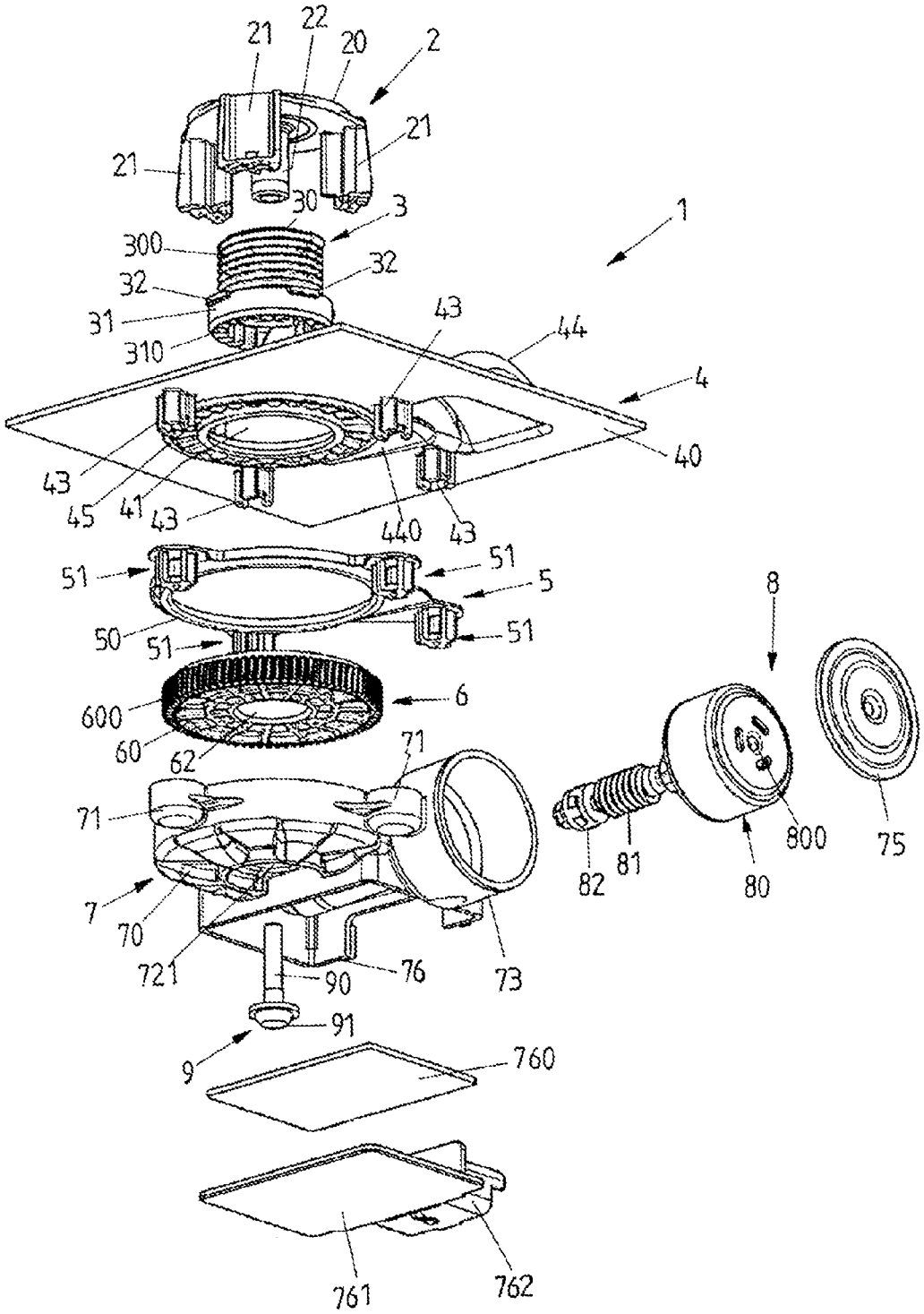
FIG. 1B shows the exploded view according to FIG. 1A from a different perspective.
Figure 2:
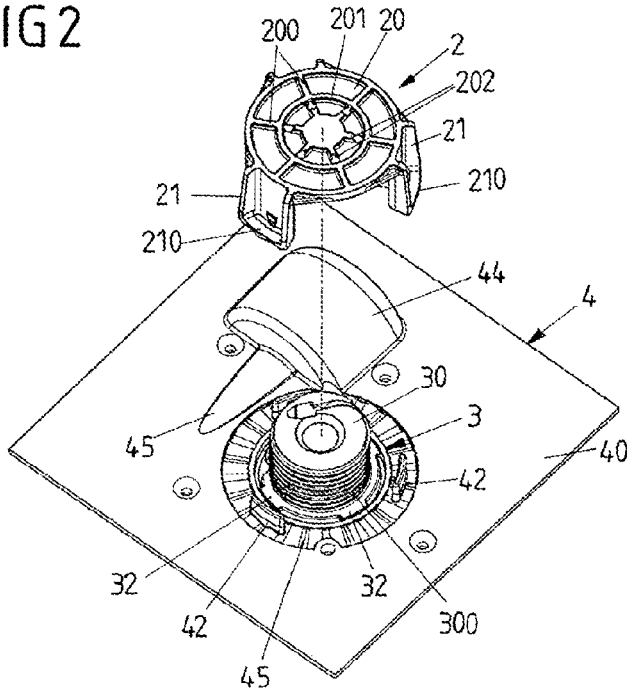
FIG. 2 shows a view of a cable exit housing before being attached to a carrier element.
Figure 3:
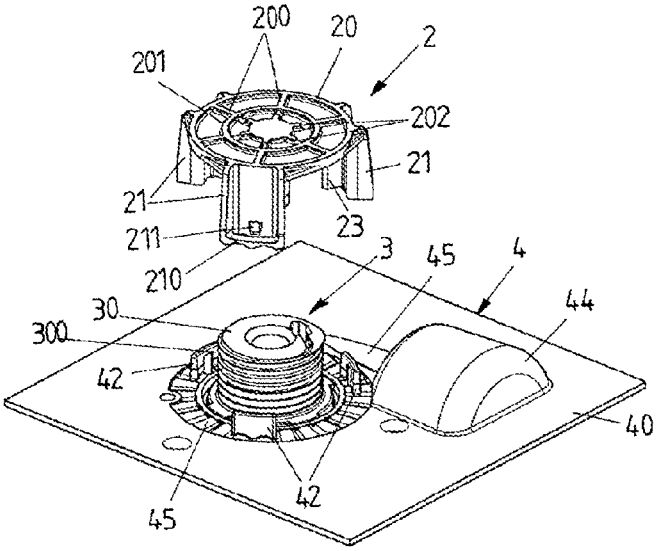
FIG. 3 shows another view of the cable exit housing before being attached to the carrier element.
Figure 4A:
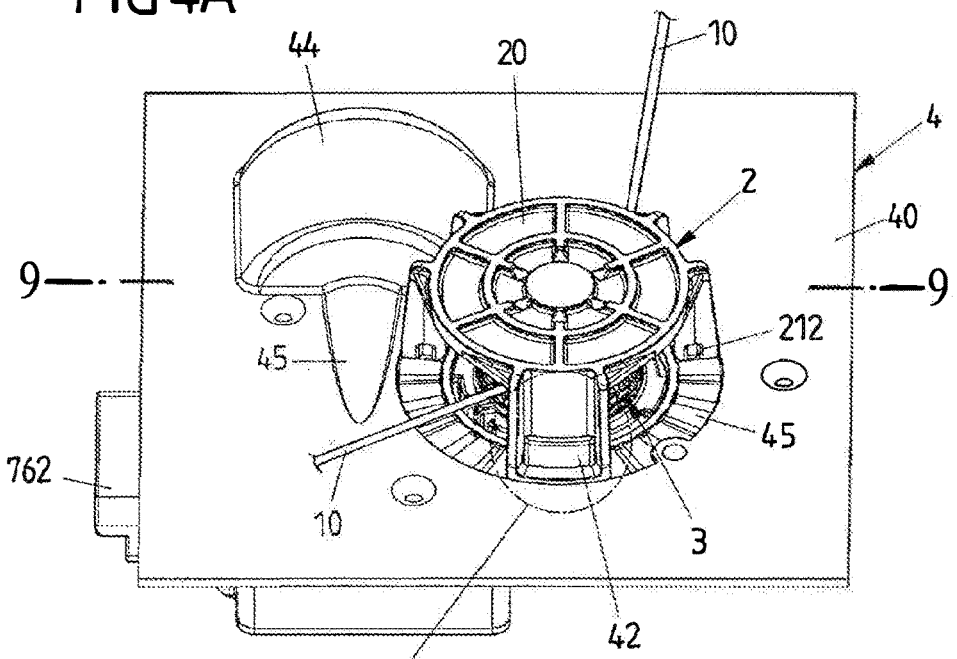
FIG. 4A shows a view of the cable exit housing on the carrier element.
Figure 4B:
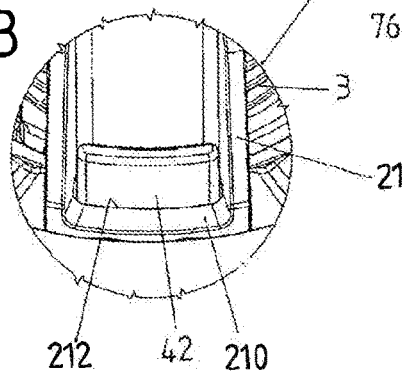
FIG. 4B shows a view enlarged in fragments of the assembly according to FIG. 4A.
Figure 5:
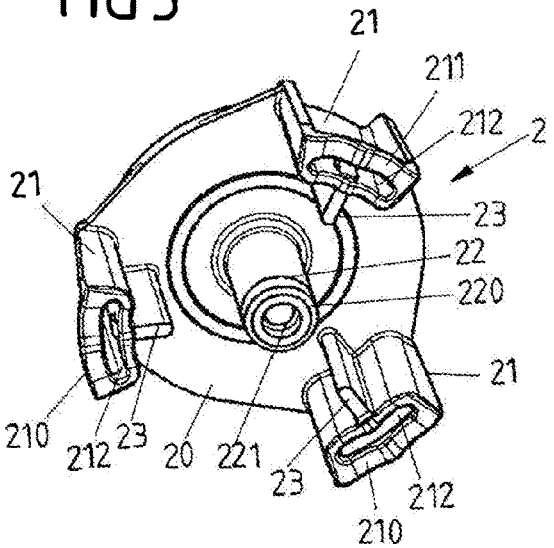
FIG. 5 shows a separate view of the cable exit housing seen from obliquely below.

The drive housing 7 is attached to the other, second side of the carrier element 4 in such a manner that the motor case 73 comes to lie in a molding 44 in the area portion 40, and the worm housing 74 comes to lie in a molding 440 in the area portion 40 that is adjacent to said worm housing 74 (cf. FIGS. 1A, 1B and 2). Fastening installations 71 in the form of engagement bushes having positive-lock openings molded therein engage with positive-lock elements 43 in the form of pins projecting from the lower side of the carrier element 4 when the drive housing 7 is attached. On account of the positive-lock openings of the fastening installations 71, exactly like the positive-lock elements 43 in the form of the pins on the carrier element 4, being radially spaced apart from the rotation axis D defined by the bearing element 72 of the drive housing 7, the drive housing on account of said positive-locking engagement is established in a rotationally fixed manner on the carrier element 4 such that an anti-rotation safeguard for the drive housing 7 is provided.

Engagement portions 51 are disposed on an annular seal 50 of the sealing element 5 on the positive-lock elements 43 of the carrier element 4, such that the positive-locking engagement of the positive-lock elements 43 with the positive-lock openings on the fastening installations 71 is performed with the intervention of the engagement portions 51. The serves for the acoustic decoupling.

A curved portion 52 which comes to lie in the region of the molding 45 for receiving the worm housing 74 is configured on the sealing element 5. The curved portion 52 forms an intermediate layer between the worm housing 74 and the carrier element 4 such that an acoustic decoupling of the drive housing 7 from the carrier element 4 is also achieved thereon.

Figure 9:
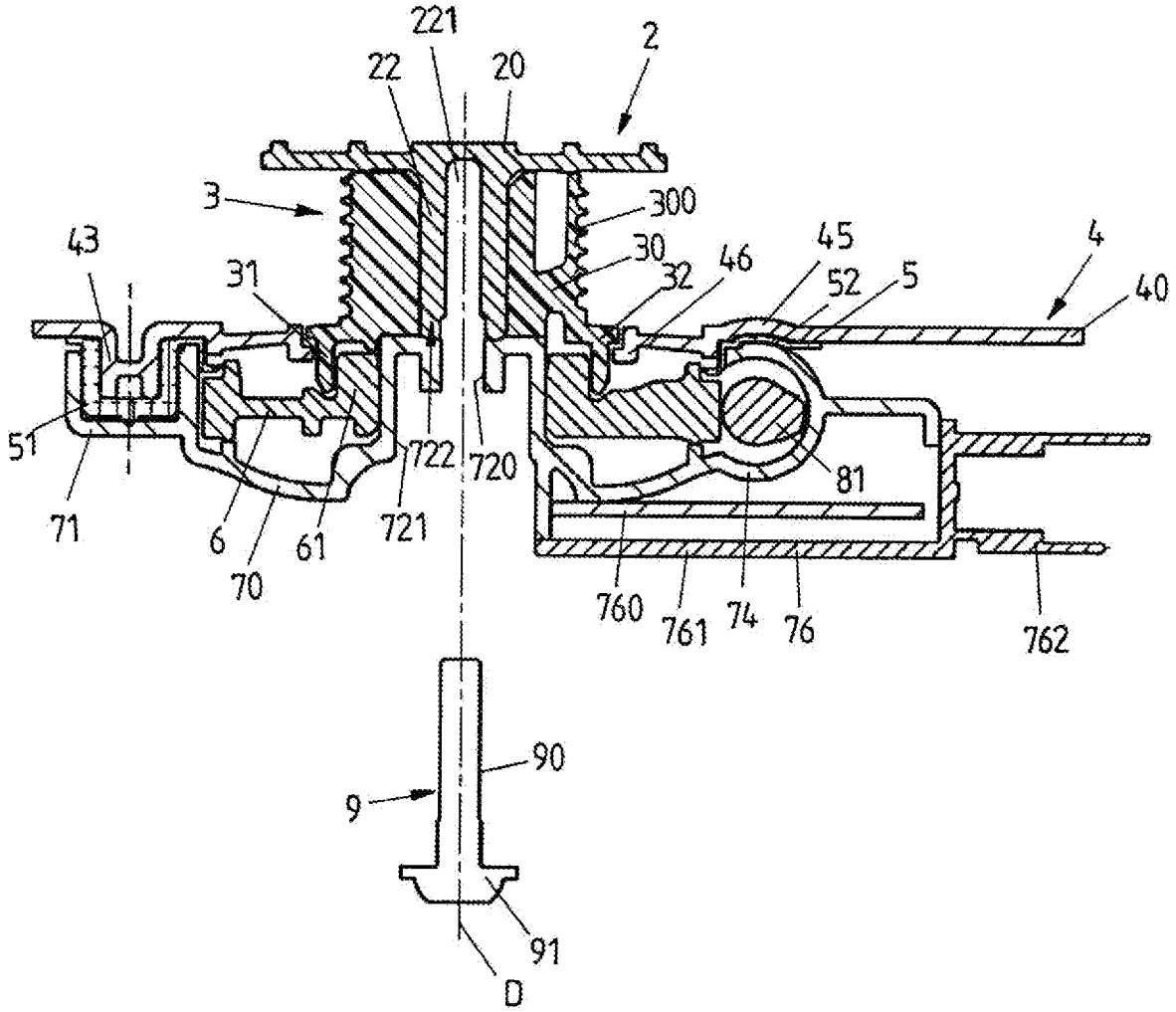
FIG. 9 shows a cross-sectional view along the line 9-9 according to FIG. 4A, before the bracing of the cable exit housing with a drive housing by way of a fastening element.

When the drive housing 7 has been attached to the carrier element 4 with the intervention of the sealing element 5, the drive housing 7 by way of the fastening element 9 is braced in relation to the cable exit housing 2 such that the cable exit housing 2 and the drive housing 7 thereby are mutually established and established on the carrier element 4. As is illustrated in FIG. 9, the fastening element 9 is inserted into the engagement opening 721 within the bearing element 72 of the drive housing 7 such that the fastening element 9 by way of a shank 90 engages through the opening 720 at the head of the bearing element 72 and engages in the opening 221 of the bearing element 22 of the cable exit housing 2. A head 91 of the fastening element 9 herein comes to lie on the side of the opening 720 that faces away from the bearing element 22 such that the cable exit housing 2 is braced in relation to the drive housing 7 by screwing the fastening element 9 into the opening 221 within the bearing element 22.

As can be seen from FIGS. 2 and 6, for example, the cable exit housing 2 on the base 20 thereof on the side that faces away from the carrier element 4 has structural elements 200, 201 in the form of reinforcement ribs which extend radially in relation to the rotation axis D defined by the bearing element 22, or extend circumferentially about the rotation axis D, and reinforce the base 20. Local recesses 202 for weakening the material on the structural elements 200 are achieved herein in the radially extending structural elements 200, said recesses 202 being disposed along a ring about the rotation axis D and achieving a predetermined deforming line for the elastic deformation of the base 20.

When the fastening element 9 is screwed into the bearing element 22 from the side of the drive housing 7, the base 20 can thus be at least slightly deformed such that production-related tolerances can be equalized and the cable exit housing 2 by way of the base portions 210 on the housing portions 21 is established in a play-free manner on the carrier element 4.

The bearing element 22 on an end that faces away from the base 20 moreover has a conical portion 220 in the form of a centering cone (cf. FIGS. 8 and 9) which when bracing the cable exit housing 2 in relation to the drive housing 7 engages in a centering engagement, shaped in a complementary manner, on the bearing element 72 of the drive housing 7, and in this way sets a centered position of the bearing element 22 of the cable exit housing 2 in relation to the bearing element 72 of the drive housing 7. Both the conical portion 220 on the end of the bearing element 22 as well as the centering engagement 722 on the head of the bearing element 72, are conically shaped and herein are mutually complementary, such that the bearing element 22 of the cable exit housing 2 in the event of an engagement is aligned so as to be centered in relation to the bearing element 72 of the drive housing 7.

The bearing element 22 of the cable exit housing 2 and the bearing element 72 of the drive housing 7 herein define a common rotation axis D for the cable drum 3, on the one hand, and for the drive wheel 6, on the other hand, such that the cable drum 3 and the drive wheel 6 when in operation can rotate in a mutually coaxial and conjoint manner.

The concept on which the solution is based is not fundamentally limited to the exemplary embodiments set forth above but can fundamentally also be implemented in an entirely different manner.

A drive device of the type described is in particular not limited to the use in a power window actuator but can also serve for adjusting another adjustment element, for example a sliding roof or the like, in a vehicle.

The drive device can be assembled in a simple manner particularly while using a (single) axially braced fastening element. An assembly comprising few assembly steps which can be simple and cost-effective paired with a reliable establishment of the cable exit housing and of the drive housing on the carrier element results.

LIST OF REFERENCE SIGNS

1 Drive device
10 Cable
11 Guide rail
110, 111 Deflection
12 Entrainment element
13 Window glass
2 Cable exit housing
20 Base
200, 201 Structural element (reinforcement rib)
202 Recess (material weakening)
21 Housing portion
210 Base portion
211 Latching element
212 Positive-lock opening (slot opening)
22 Bearing element (bearing dome)
220 Centering cone
221 Opening
23 Safeguard
3 Cable drum
30 Body
300 Cable channel
31 Ring gear
310 Toothing
32 Bearing element
4 Carrier element (apparatus carrier)
40 Area portion
41 Opening
42 Positive-lock element

420 Latching clearance
43 Positive-lock element
44 Molding
440 Molding
45 Contact ring
46 Counter bearing (bearing ring)
5 Sealing element
50 Annular seal
51 Engagement portion
52 Curved portion
6 Drive wheel
60 Body
600 External toothing
61 Connecting wheel
610 Toothing
62 Opening
7 Drive housing
70 Housing case
71 Fastening installation (engagement bush)
72 Bearing element (bearing dome)
720 Opening
721 Engagement opening
722 Centering engagement
73 Motor case
74 Worm housing
75 Housing cover
76 Electronics housing
760 Circuit board
761 Housing plate
762 Plug connector
8 Motor unit
80 Electric motor
800 Drive shaft
81 Drive worm
82 Bearing
9 Fastening element
90 Shank
91 Head
D Rotation axis
X1, X2, X3 Play

The invention claimed is:

1. A drive device for an adjustment apparatus for adjusting a vehicle part, comprising a carrier element defining an opening;

a cable drum including a portion inserted into the opening of the carrier element in such a manner that the portion at least partially extends through the opening;

a cable exit housing disposed on a first side of the carrier element and including a first bearing element disposed on the first side of the carrier element and the first bearing element supporting the cable drum, the cable drum being rotatable about a rotational axis;

a drive wheel drivable by a motor unit; and a drive housing disposed on a second side of the carrier element facing away from the first side, the drive housing including a second bearing element supporting the drive wheel, the drive wheel being rotatable about the rotational axis;

wherein the cable drum includes a plurality of support elements projecting from the portion such that the support elements are oriented radially relative to the rotational axis, the support elements extending radially across a counter section of the carrier element which comprises a peripheral edge of the carrier element surrounding the opening of the carrier element;

wherein the plurality of support elements are configured to be supported on the counter section such that the counter section blocks a movement of the cable drum through the opening of the carrier element;

wherein the portion of the cable drum includes a ring gear connecting the cable drum to the drive wheel such the cable drum and the drive wheel are rotationally fixed.

2. The drive device as claimed in claim 1, wherein the counter section is formed by a support ring that surrounds the opening of the carrier element.

3. The drive device as claimed in claim 1, wherein the cable exit housing is connected to the carrier element by a latch-fit connection.

4. The drive device as claimed in claim 1, wherein the cable exit housing has at least one housing portion that is radially spaced apart from the rotational axis and that is fixed on the carrier element such that the cable exit housing is held on the carrier element to be rotationally fixed in relation to the rotational axis.

5. The drive device as claimed in claim 4, wherein the housing portion includes a base portion that is attached to the carrier element, wherein one of the base portion or the carrier element includes a positive-lock element and the other of the base portion or the carrier element includes a positive-lock opening, the positive-lock element engaging with the positive-lock opening.

6. The drive device as claimed in claim 5, wherein the positive-lock element engages in a latching manner in the positive-lock opening.

7. The drive device as claimed in claim 1, wherein the cable exit housing and the drive housing are fastened to one another by a fastening element that acts between the first bearing element and the second bearing element.

8. The drive device as claimed in claim 7, wherein the fastening element is a screw element connecting the cable exit housing and the drive housing along the rotational axis.

9. The drive device as claimed in claim 1, wherein the drive housing has at least one fastening device that is radially spaced apart from the second bearing element, the fastening device fixing the drive housing on the carrier element such that the drive housing is held on the carrier element so as to be rotationally fixed in relation to the rotational axis.

10. The drive device as claimed in claim 9, wherein one of the carrier element and the fastening device includes a positive-lock element and the other of the carrier element and the fastening device includes a positive-lock opening, the positive-lock element engaging with the positive-lock opening.

* * * * *